United States Patent [19]

Kurtz

[11] Patent Number: 4,567,846

[45] Date of Patent: Feb. 4, 1986

[54] MAGNETICALLY OPERATED DOOR CHIME

[76] Inventor: Thomas D. Kurtz, 510 Island View Rd., Rock Falls, Ill. 61071

[21] Appl. No.: 715,674

[22] Filed: Mar. 25, 1985

[51] Int. Cl.[4] ..... G08B 13/08

[52] U.S. Cl. ..... 116/86; 49/13; 116/100; 116/141; 116/148

[58] Field of Search ..... 116/85, 86, 88, 95, 116/100, 141, 148, 204; 340/545, 547, 551; 49/13, 14; 160/10; 335/205, 207

[56] References Cited

U.S. PATENT DOCUMENTS

| | | | |
|---|---|---|---|
| 2,206,837 | 7/1940 | Edwards | 116/172 |
| 2,600,581 | 6/1952 | Schenendorf | 340/547 |
| 3,451,373 | 6/1969 | Fox et al. | 116/100 |
| 4,062,314 | 12/1977 | Allen et al. | 116/85 |
| 4,094,266 | 6/1978 | Artt | 116/100 |

*Primary Examiner*—Steven L. Stephan
*Assistant Examiner*—Patrick R. Scanlon
*Attorney, Agent, or Firm*—Vernon J. Pillote

[57] ABSTRACT

A magnetically operated door chime adapted for mounting on a door and door frame. The door chime includes a casing adapted for mounting on the door frame and having a plunger assembly mounted for reciprocation along a horizontal path perpendicular to the plane of the door when the door is closed. The plunger assembly includes a first magnetic unit on its outer end arranged in face-to-face contact with a second magnetic unit on the door, when the door is closed. A chime bar extends across the path of movement of the other end of the plunger assembly and a spring yieldably biases the plunger assembly in a direction toward the chime bar. The spring is yieldable under the magnetic force between the first and second magnetic units so that the plunger assembly moves with the second magnetic unit as the door is moved away from its closed position until the compression of the spring overcomes the magnetic force between the first and second magnetic units and moves the plunger in the other direction in an impact stroke against the chime bar. A second spring is arranged to move the plunger a short distance in opposition to the first spring to retract the plunger a short distance away from the chime bar and to provide a yieldable abutment for the first magnetic unit when the door is closed.

8 Claims, 7 Drawing Figures

Fig. 4.
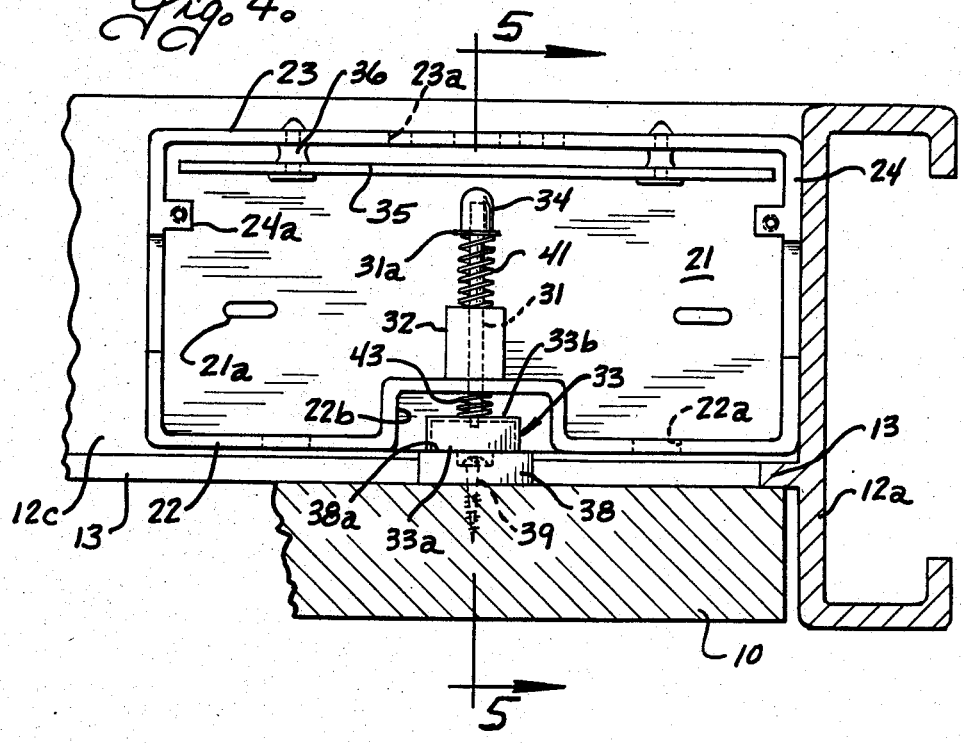
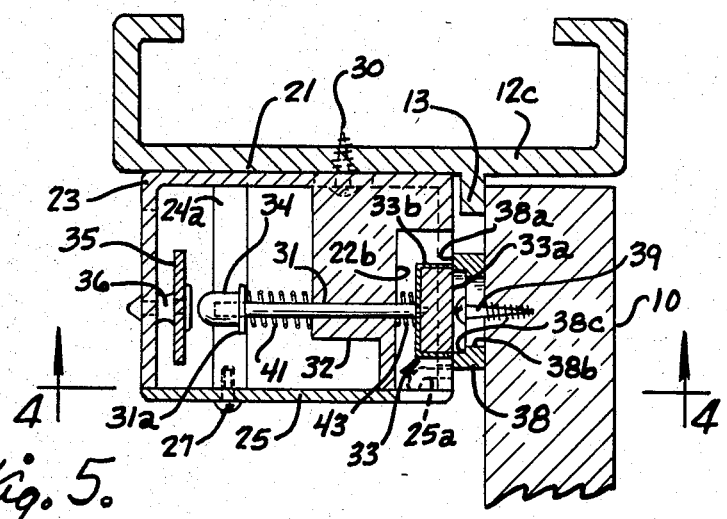
Fig. 5.

Fig. 6.
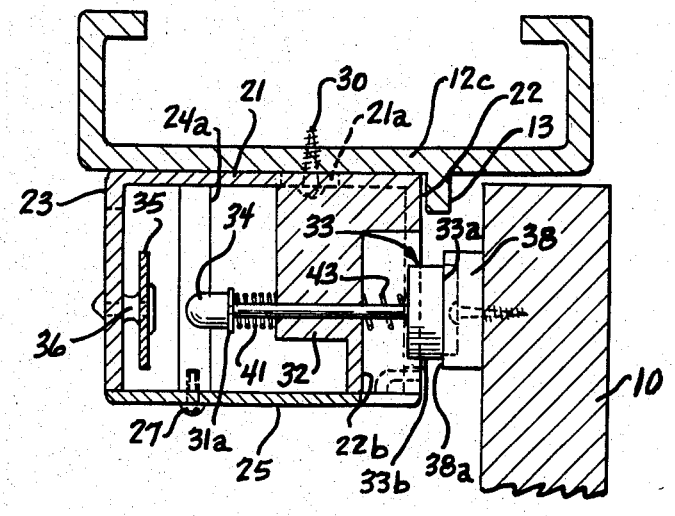
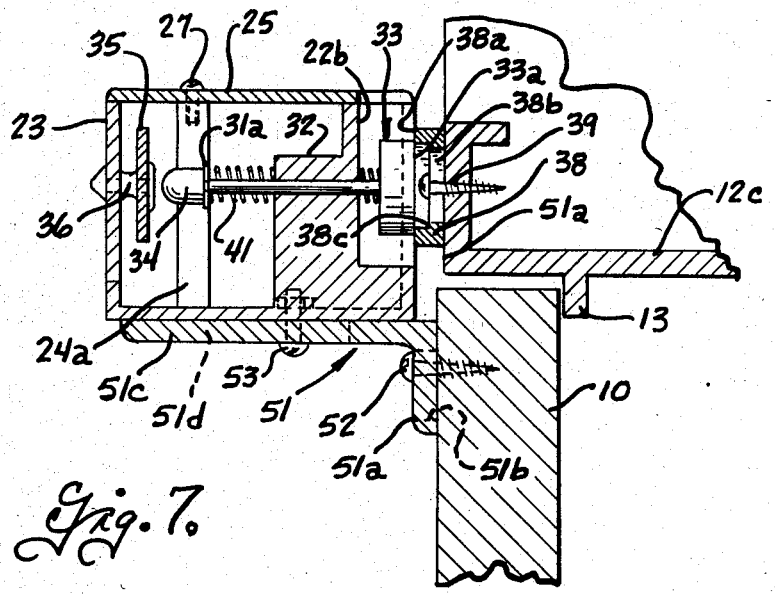
Fig. 7.

MAGNETICALLY OPERATED DOOR CHIME

BACKGROUND OF THE INVENTION

U.S. Pat. No. 4,062,314 discloses a magnetically operated door chime. In this patent a striker pin is mounted in a housing for vertical reciprocation adjacent the upper edge of a door, and a magnetically polarized piece is provided at the upper end of the striker pin. A chime bar is mounted on the housing below the lower end of the striker pin and a spring yieldably biases the striker pin upwardly out of contact with the chime bar. A magnet is mounted by a holder on the door frame at a location to overlie the magnetically polarized piece on the striker pin when the door is closed, and the magnet is arranged to magnetically attract and raise the striker pin when the door is closed. When the door is opened, the magnetically polarized piece on the striker pin moves out of a position below the magnet on the door frame and allows the striker pin to fall with the aid of gravity and strike the chime bar. A second magnet polarized opposite to the polarity of the magnetically polarized piece on the striker pin is provided on the holder attached to the door frame at a location such that the magnetically polarized piece on the striker pin moves under the second magnet as the door is opened and the second magnet repels the striker pin and aids in moving the same downwardly toward the chime bar.

The magnetic attracting and repelling forces between two magnets decreases rapidly as the air gap therebetween increases. In the magnetically operated door chime disclosed in U.S. Pat. No. 4,062,314, a substantial minimum air gap must be provided between the magnet on the striker carried by the door and the magnet on the holder carried by the door frame to allow clearance for movement of the door between open and closed positions. In addition, the magnets must operate through an air gap that is substantially greater than the minimum air gap in order to attract and raise the striker pin preparatory to a chime operating stroke of the pin. Changes in ambient temperature and/or humidity can change the operating clearance between the door and door frame and affect the minimum air gap. In addition, the need for the magnet to operate through a relatively long air gap in order to raise the striker, limits the maximum possible stroke of the striker and hence the impact forces available to move the striker against the chime bar.

SUMMARY OF THE INVENTION

It is an object of the present invention to overcome the disadvantages of the prior art by providing a magnetically operated door chime having one magnetic unit mounted on the door and another magnetic unit on the door frame arranged so that the magnetic units are in face-to-face contact when the door is closed and in which one of the magnetic units is mounted on a plunger supported for reciprocation along a path transverse to the plane of the door when the door is closed and such that the magnetic units remain in face-to-face contact as the door is moved away from its closed position to draw the plunger a selected distance against the bias of a spring before releasing the plunger to travel in an impact stroke against the chime bar.

BRIEF DESCRIPTION OF THE DRAWINGS

FIG. 4 is a fragmentary horizontal sectional view of the magnetically operated door chime taken on the plane 4—4 of FIG. 5;

FIG. 5 is a vertical sectional view taken on the plane 5—5 of FIG. 4;

FIG. 6 is a vertical sectional view taken on the plane 6—6 of FIG. 4 and illustrating the door in a moved position; and FIG. 7 is a fragmentary vertical sectional view illustrating an alternate mounting arrangement for the magnetically operated door chime on the door and door frame.

DETAILED DESCRIPTION

Figure 1:
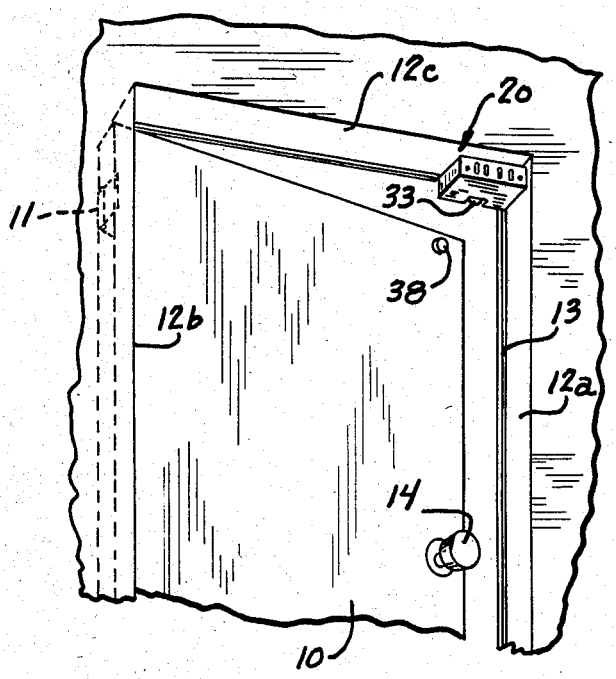
FIG. 1 is a fragmentary perspective view of a door and door frame illustrating a magnetically operated door chime of the present invention applied thereto.
Figure 2:
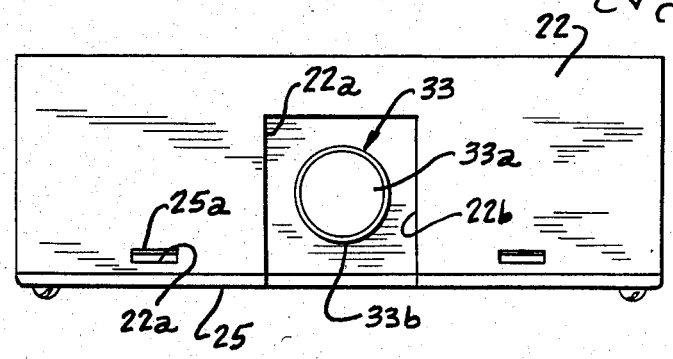
FIG. 2 is a front view of a magnetically operated door chime.

The present invention is adapted for use on door closures of the type shown in FIG. 1 and which include a door 10 that is hingedly mounted adjacent one edge by hinges 11 on a door frame having spaced doorjams **12*a* and 12*b* and a door header 12*c* extending between the upper ends of the doorjams. The hinges support the door for swinging movement about a generally upright hinge axis adjacent one edge of the door and the door is movable into and out of a closed position against a doorstop 13 on the doorjams and door header of the door frame. A door latch 14 is provided on the door adjacent edge remote from the hinges 11** to latch the door in its closed position.

A sonic signaling device, herein sometimes referred to as door chime, is mounted on the door and door frame to provide a sonic alarm to indicate when the door is moved away from its closed position toward an open position. In the embodiment shown, the door chime is enclosed in a casing 20 having a generally rectangular configuration and which includes a top wall 21, front and rear walls 22, 23, and end walls 24. A cover 25 is removably attached to the casing, as by hooks **25*a* that extend into openings 22*a* in the front wall, and fasteners 27 that extend into bosses 24*a* on the end walls 24**.

The casing is preferably molded of a suitable rigid plastic and a plunger 31 is slidably supported in a plunger guide 32 conveniently molded integrally with the front and top walls 22, 21 respectively. A first magnetic unit 33 is mounted on one end of the plunger and disposed externally of the casing and a striker nose 34 is provided at the other end of the plunger and located internally of the casing. The front wall 22 of the casing is preferably formed with an inwardly offset portion **22*b* to provide a cavity at the outer side of the front wall for receiving the first magnetic unit 33**.

Figure 3:
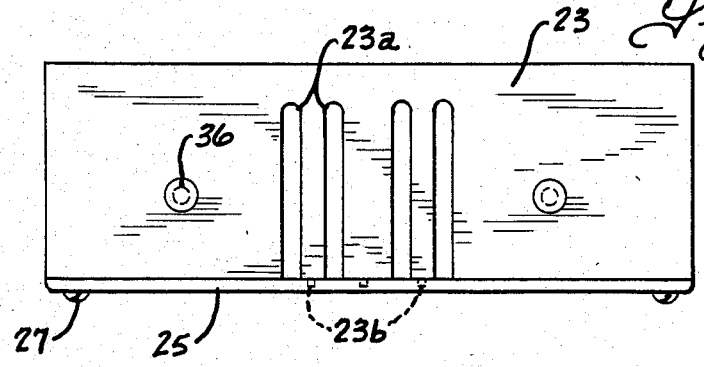
FIG. 3 is a rear view of the magnetically operated door chime.

A sonically vibratile element 35, herein shown in the form of a chime bar, is mounted on the casing as by resilient suspension members 36, formed of an elastomeric material or the like. The resilient suspension members extend through openings in the chime bar and rear wall and support the chime bar in a manner to allow relatively free vibration. The chime bar and suspension members are conveniently of the type commonly used in conventional electromagnetically operated door chimes and further detailed description is deemed unnecessary. Openings 23*a* are provided in the rear wall adjacent the central portion of the chime bar to facilitate passage of sound from the casing. In order to facilitate molding of the casing, the openings 23*a* can be extended to the lower edge of the rear wall 23 as shown in FIG. 3. Protrusions 23*b* on the lower ends of the rear wall portions between the openings extend into recesses in the cover 25 to stabilize these rear wall portions.

The casing of the door chime is mounted on either the door or the door frame at a location spaced from the hinge axis of the door and with the plunger 31 supported for reciprocation along a horizontal path perpendicular to the plane of the door 10, when the door is in its closed position against the doorstops 13. In the embodiment of FIGS. 1–6, the chime unit is mounted on the door frame, at a location spaced from the hinge axis and preferably on the header 12*c* adjacent the doorjam 12*b* remote from the hinge. As shown in FIGS. 4–6, the top wall 21 of the casing has openings 21*a* and mounting screws 30 extend through the openings and into the door frame. The openings 21*a* are preferably elongated in a direction transverse to the front wall to facilitate adjustment of the casing on the door frame in a direction perpendicular to the plane of the door. The first magnetic unit 33 has an end face 33*a* disposed perpendicular to the path of movement of the plunger. A second magnetic unit 38 is mounted on the other of the items such as the door 10 and has a second face 38*a* arranged to be juxtaposed to the first face on the first magnetic unit when the door is in its closed position, as shown in FIGS. 4 and 5. At least one of the magnetic units such as the magnetic unit 33 includes a permanent magnet and the other of the magnetic units 38 is formed of a magnetizable material and may, if desired, comprise another permanent magnet. The magnetic units are constructed and arranged to magnetically hold each other when their respective first and second faces are in contact with a magnetic holding force to move the plunger assembly in one direction along the plunger path with the door as the door is moved away from its closed position. In the preferred embodiment illustrated, the magnetic unit 33 is mounted within a cup shaped member 33*b* formed of a ferromagnetic material and the magnet is preferably polarized so that one pole is at the end face 33*a* and the other pole contacts the bottom of the cup, with the flange on the cup extending around the magnet and with its end face disposed generally coplanar with the end face 33*a*. The other magnetic unit 38 conveniently comprises a piece of magnetizable material such as a ferromagnetic material and, as shown, the magnetic unit 38 is mounted on the door as by a screw 39 that extends through a vertically elongated slot 38*b* in the magnetic unit to allow limited adjustment of the unit 38 in a direction crosswise of the plunger axis. The magnetic unit 38 is recessed as indicated at 38*c* in FIG. 5 to receive the head of the screw and allow the end face 38*a* to contact the end face 33*a* on the other magnetic unit, when the door is in a closed position. As previously described, the magnetic unit 38 can also include a permanent magnet polarized in relation to the polarity of the magnetic unit 33 so that they attract each other when in face-to-face contact.

As best shown in FIG. 4, the chime bar 35 has an intermediate portion that extends crosswise of the path of movement of the nose portion 34 on the plunger 31. A first spring 41 is provided for yieldably biasing the plunger in a direction toward the chime bar. The spring 41 is preferably a coil type compression spring that is interposed between a stationary abutment formed by the plunger guide 32 and a shoulder or abutment 31*a* on the inner end of the plunger. The shoulder 31*a* can conveniently be formed by a split ring that seats in a groove or notch in the plunger. The plunger and the first magnetic unit 33 move as a unit and the first spring 41 is constructed and arranged to yield and allow the plunger assembly to move a selected distance with the first magnetic unit 33 in contact with the second magnetic unit 38, as the door is moved from its closed position as shown in FIG. 5 to a partially open position as shown in FIG. 6. The spring 41 may, for example, have a length and spring rate such that it allows the plunger assembly to move a distance of the order of ½ inch or more with the magnetic unit 38, and until the pressure exerted by the spring is sufficient to overcome the magnetic force between the units 33 and 38. When the spring 41 is compressed sufficient to overcome the magnetic force between the units 33 and 38, the spring rapidly moves the plunger assembly in the opposite direction to impact the nose portion of the plunger assembly against the chime bar 35.

A second spring 43 is provided for yieldably biasing the plunger in a direction opposite the direction of movement by spring 41. The second spring 43 is also preferably a coil type compression spring disposed between the magnetic unit 33 on the plunger and a stationary abutment formed by the plunger guide 32. The second spring 43 is arranged to yieldably urge the plunger assembly in a direction opposite the direction of movement of the spring 41, to position the nose portion 34 on the plunger assembly a short distance away from the chime bar, when there is no other axial force on the plunger assembly. This allows the chime bar to vibrate freely after the nose portion of the plunger has impacted on the chime bar. The second spring 43, however, has a relatively short length as compared to the spring 41 and has a spring rate that is sufficiently low to yield under the combined forces of the first spring 41 and the inertia of the plunger assembly during the impact stroke of the plunger assembly. The springs 41 and 43 are of selected relation to each other and to the length of the plunger assembly such that the nose portion on the plunger is spaced a short distance from the chime bar when the end face 33*a* of the first magnetic unit is disposed in a preselected relation to the front face of the casing. The arrangement may, for example, be such that the end face of the first magnetic unit is approximately coplanar with the outer face of the front wall of the casing, when the plunger assembly is in its rest or null position. The other magnetic unit 38 is mounted on the face of the door and, as shown, has a thickness sufficient to span the space between the door and the face of the first magnetic unit when the door is closed. The slots 21*a* for the mounting screws 30 allow adjustment of the the casing on the door frame in a direction transverse to the face of the door to a position in which the face of the first magnetic unit contacts the face of the second magnetic unit when the door is closed. As will be apparent from the drawings, the second spring 43 also provides a yieldable abutment for the first magnetic unit, when the door is closed. This not only minimizes the likelihood of damage to the magnetic units due to impact, but also accommodates some variations in thickness of the second magnetic unit or position of the casing 20 when the door is in its closed position against a doorstop 13.

The arrangement shown in FIGS. 1–6 in which the door chime casing is mounted on the door frame, is adapted for use with out swinging doors, that is doors that swing outwardly from the room in which it is desired to have the door chime located. In order to enable the door chime to be located within a room on in swinging doors, that is on doors that swing into the room in which the chime is located, provision is made for mounting the door chime on the door for movement therewith as shown in FIG. 7. More particularly, a generally L-shaped mounting bracket 51 is provided and has one leg 51*a* arranged to be attached to the inner side of the door by screws 52 that extend through vertically elongated slots 51*b* in the leg 51*a*. The other leg 51*c* of the bracket extends laterally from the upper edge of the door and fasteners such as bolts 53 extend through slots 51*d* in the leg 51*c* and through slots 21*a* (FIG. 4) in the wall 21 of the casing. In this embodiment, the second magnetic unit 38 is mounted as by the aforementioned screw 39 on the door frame at a location such that its end face 38*a* is adapted to register with the end face 33*a* of the first magnetic unit 33, when the door is closed as shown in FIG. 10. The slot 51*d* in the bracket leg 51*c* is elongated in a direction paralleling the plunger path to enable adjustment of the door chime casing in a direction perpendicular to the door to accommodate door frames having different face trim. The slots 21*a* are preferably elongated in a direction transverse to the plunger path to facilitate lateral alignment of the magnetic unit 33 with the unit 38. The operation of the door chime is the same as that previously described except that the door chime is operated in response to movement of the door inwardly of the room, that is to the left as viewed in FIG. 7.

From the foregoing it is thought that the construction and operation of the door signaling device will be readily understood. The door plunger is mounted for movement along a plunger path perpendicular to the plane of the door when the door is closed, and at a location spaced from the hinge axis of the door, and the first and second magnetic units on the plunger and door are arranged so that their end faces are in face-to-face contact when the door is closed. During opening of the door, the first magnetic unit is magnetically held in face-to-face contact with the second unit and is moved relative to the casing against the bias of spring 41 during initial opening of the door. When the compression of spring 41 overcomes the magnetic force between the magnetic units, the first magnetic unit is disengaged from the second unit and the plunger assembly moves under the bias of spring 41 in an impact stroke against the chime bar. The power for compressing the spring is thus provided by the force used to open the door. The second spring 43 retracts the plunger assembly a short distance away from the chime bar after impact and also provides a yieldable stop for the first magnetic unit when the second magnetic unit engages its end face upon closing of the door.

The embodiments of the invention in which an exclusive property or privilege is claimed are defined as follows:

1. In a door closure including two items comprising a door frame and a door hingidly mounted adjacent the edge on the door frame for swinging movement about an upright hinge axis into and out of a closed position against a door stop on the door frame, a sonic device for signalling opening of the door comprising, a casing mounted on one of the items comprising the door and door frame at a location spaced from the hinge axis, a plunger assembly including an elongated plunger, plunger guide means on the casing slidably engaging the plunger intermediate its ends and supporting the plunger for reciprocation along a generally horizontal plunger path transverse to the plane of the door when the door is in its closed position, the plunger assembly including a first magnetic unit mounted on one end of the plunger for movement with the plunger and having a first face disposed transverse to the plunger path, a second magnetic unit fixidly mounted on the other of said items and having a second face positioned to be juxtaposed to the first face on the first magnetic unit when the door is in its closed position, one of the magnetic units including a permanent magnet and the other of the magnetic units including a magnetizable member, said first and second magnetic units being constructed and arranged to magnetically hold each other when the respective first and second faces are in contact with a magnetic holding force to move the plunger assembly in one direction along the plunger path when the door is moved away from its closed position, the plunger assembly including a nose portion at the end remote from the first magnetic unit and movable with the plunger, a sonically vibratile element mounted on the casing and having a portion extending crosswise of the path of movement of the nose portion of the plunger assembly when the latter is moved in the other direction along the plunger path, a first spring means yieldably biasing said plunger assembly in said other direction along the plunger path and being constructed and arranged to yield and allow the plunger assembly to move a selected distance with the second magnetic unit in said one direction along the plunger path as the door is moved away from its closed position, the first spring means being operative when the magnetic units move out of contact to move said plunger assembly in the other direction in an impact stroke along the plunger path and impact the nose portion of the plunger assembly against the sonically vibratile element.

2. The combination of claim 1 including a second spring means for yieldably biasing said plunger in said one direction a short distance away from said vibratile element after the nose portion impacts on the vibratile element, said second spring means being yieldable under the combined forces of said first spring means and the inertia of said plunger assembly during said impact stroke to allow the nose portion of the plunger to impact against the vibratile element.

3. The combination of claim 2 wherein the casing is mounted on the door frame and the second magnetic unit is mounted on the door for movement therewith.

4. The combination of claim 2 wherein the casing is mounted on the door for movement therewith and the second magnetic unit is mounted on the door frame.

5. In a door closure including two items comprising a door frame and a door hingidly mounted adjacent one edge on the door frame for swinging movement about an upright hinge axis into and out of a closed position against a doorstop on the door frame, a sonic device for signalling opening of the door comprising, a casing mounted on one of the items comprising the door and door frame at a location spaced from the hinge axis, a plunger assembly including an elongated plunger, plunger guide means on the casing slidably engaging the plunger intermediate its ends and supporting the plunger for reciprocation along a generally horizontal plunger path transverse to the plane of the door when the door is in its closed position, the plunger assembly including a first magnetic unit mounted on one end of the plunger for movement with the plunger and having a first face disposed transverse to the plunger path, a second magnetic unit fixedly mounted on the other of said items and having a second face positioned to be juxtaposed to the first face on the first magnetic unit when the door is in its closed position, one of the magnetic units including a permanent magnet and the other of the magnetic units including a magnetizable member, said first and second magnetic units being constructed and arranged to magnetically hold each other when the respective first and second faces are in contact with a magnetic holding force to move the plunger assembly in one direction along the plunger path when the door is moved away from its closed position, the plunger assembly including a nose portion at the end remote from the first magnetic unit and movable with the plunger, a sonically vibratile element mounted on the casing and having a portion extending crosswise of the path of movement of the nose portion of the plunger assembly when the latter is moved in the other direction along the plunger path, a first coil type compression spring yieldably urging said plunger assembly in the other direction along said path and being constructed and arranged to yield and allow the plunger assembly to move in said one direction along the plunger path a selected distance with the second magnetic unit as the door is moved away from its closed position and to overcome the magnetic force and separate the first magnetic unit from the second magnetic unit when the first spring has been compressed a preselected amount, the first spring being operative when the second magnetic unit is separated from the first magnetic unit to move the plunger assembly in said one direction in an impact stroke along the plunger path and impact the nose portion of the plunger assembly against the sonically vibratile element, a second coil type compression spring having an undistended length shorter than the undistended length of the first spring for yieldably biasing said plunger in said one direction a short distance away from the vibratile element after the nose portion impacts on the vibratile element, said second spring being yieldable under the combined forces of said first spring and the inertia of the plunger assembly in said impact stroke to allow the nose portion of the plunger assembly to impact against the vibratile element.

6. The combination of claim 5 wherein the first spring is disposed around the plunger and has one end engaging said plunger guide means and the other end engaging a shoulder on the plunger, said second spring being disposed around the plunger and having one end engaging the plunger guide means and the other end engaging said first magnetic unit.

7. The combination of claim 5 wherein the casing is mounted on the door frame and the second magnetic unit is mounted on the door for movement therewith.

8. The combination of claim 5 wherein the casing is mounted on the door for movement therewith and the second magnetic unit is mounted on the door frame.

* * * * *